United States Patent [19]

Gersbach

[11] 4,433,283

[45] Feb. 21, 1984

[54] BAND GAP REGULATOR CIRCUIT

[75] Inventor: John E. Gersbach, Burlington, Vt.

[73] Assignee: International Business Machines Corporation, Armonk, N.Y.

[21] Appl. No.: 325,889

[22] Filed: Nov. 30, 1981

[51] Int. Cl.[3] ..... G05F 3/20

[52] U.S. Cl. ..... 323/314; 323/315; 323/907; 307/297; 330/288; 330/289

[58] Field of Search ..... 323/313, 314, 315, 316, 323/907; 307/296 R, 297, 310; 330/288–291

[56] References Cited

U.S. PATENT DOCUMENTS

| | | | |
|---|---|---|---|
| 3,887,863 | 6/1975 | Brokaw | 323/314 |
| 4,085,359 | 4/1978 | Ahmed | 323/314 |
| 4,091,321 | 5/1978 | Hanna | 323/314 |
| 4,325,017 | 4/1982 | Schade, Jr. | 323/907 X |
| 4,352,056 | 9/1982 | Cave et al. | 323/314 |
| 4,362,985 | 12/1982 | Tsuchiya | 323/907 X |

OTHER PUBLICATIONS

A. P. Brokaw, IEEE Journal of Solid-State Circuits, Dec. 1974, vol. SC-9, pp. 388-393, "A Simple three--Terminal IC Bandgag Reference".

*Primary Examiner*—Peter S. Wong

*Attorney, Agent, or Firm*—Stephen J. Limanek

[57] ABSTRACT

A self-starting, negative voltage band gap regulator is provided, which includes a transconductance amplifier having first and second transistors and a resistive network, a current mirror circuit coupled to the amplifier and a negative feedback circuit connected from the collector of one of the transistors to the emitters of the transistors through said resistive network. First and second matched impedances, such as diodes, are included in the current mirror circuit and in the feedback circuit, respectively. The output voltage is taken from the feedback circuit.

19 Claims, 1 Drawing Figure

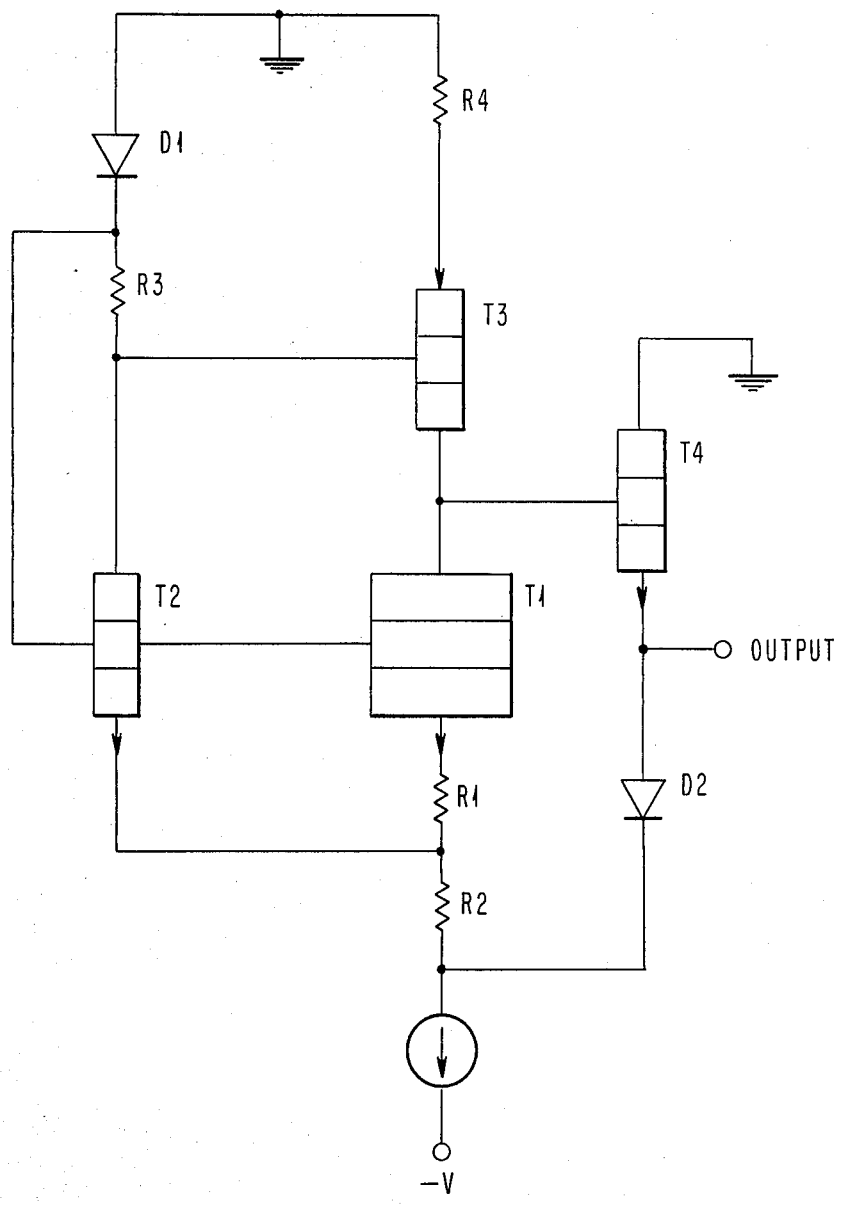
R4
D1
R3
T3
T4
T2
T1
OUTPUT
R1
D2
R2
-V

BAND GAP REGULATOR CIRCUIT

DESCRIPTION

1. Technical Field

This invention relates to integrated semiconductor circuits and more particularly to a circuit which provides a stable reference voltage unaffected by temperature variations.

2. Background Art

Circuits for providing stable reference voltages are well known, particularly circuits used with high voltage supplies that incorporate a Zener diode, i.e., an avalanche breakdown diode. With lower voltage supplies, diodes which are temperature compensated to the band gap voltage of, say, silicon have been used to provide low stable reference voltages.

In an article entitled, "A Simple Three-Terminal IC Bandgap Reference", by A. P. Brokaw, IEEE Journal of Solid-State Circuits, December 1974, vol. SC-9, pp. 388–393, there is disclosed a two-transistor circuit wherein the emitter of one of the transistors is made larger than that of the other transistor using collector current sensing with a current mirror load. A field effect transistor is provided in this bipolar circuit to provide starting means.

U.S. Pat. No. 4,085,359, filed Aug. 12, 1976, by A. A. A. Ahmed, discloses a band gap voltage reference circuit similar to that disclosed in the Brokaw article but provides a starting circuit which includes additional first and second diodes and a resistor serially arranged between a positive voltage supply terminal and ground, and a bipolar transistor having an input connected to a point on the series circuit and an output connected to an amplifier of the reference circuit.

U.S. Pat. No. 4,091,321, filed Dec. 8, 1976, by J. E. Hanna, discloses a reference circuit providing a regulated output voltage less than the silicon band gap voltage. In this circuit a voltage is developed across a resistor having a positive temperature coefficient which is the difference between the base-emitter voltage drops of two transistors operating at different current levels, and a current source is utilized in this circuit.

DISCLOSURE OF THE INVENTION

It is an object of this invention to provide an improved circuit producing a low negative reference voltage.

It is another object of this invention to provide an improved low negative reference voltage circuit having a fixed or zero temperature coefficient.

It is yet another object of this invention to provide a simple negative band gap regulator circuit.

It is still another object of this invention to provide a reference circuit of small size which produces a stable and accurate voltage with respect to a more positive terminal regardless of temperature or power supply variations.

In accordance with the teachings of this invention, a band gap regulator is provided which comprises a transconductance amplifier including first and second transistors having a current mirror circuit coupled thereto. A negative feedback circuit is coupled from a common point between the amplifier and the current mirror circuit to the emitters of the first and second transistors. The reference voltage is developed across a portion of the feedback circuit.

The foregoing and other objects, features and advantages of the invention will be apparent from the following and more particular description of the preferred embodiment of the invention, as illustrated in the accompanying drawing.

BRIEF DESCRIPTION OF THE DRAWING

The single FIGURE is a circuit diagram of a preferred embodiment of the band gap regulator of the present invention.

BEST MODE FOR CARRYING OUT THE INVENTION

Referring to the circuit in the FIGURE of the drawing in more detail, there is illustrated the preferred embodiment of the band gap regulator of the invention which includes a transconductance amplifer having first and second bipolar transistors T1 and T2, of the NPN type, and first and second resistors R1 and R2, a current mirror circuit having a third bipolar transistor T3, of the PNP type, a first diode D1 and third and fourth resistors R3 and R4 and a negative feedback circuit having a fourth bipolar transistor T4, of the NPN type, a second diode D2 and a current source, indicated by an arrow, connected to a negative voltage terminal −V, which may be equal to, e.g., −5 volts. The values of the resistors R1, R2, R3 and R4 may be equal to 300, 1800, 100 and 100 ohms, respectively. The emitter area ratio of transistors T1 to T2 is equal to four with these resistor values, while the current mirror ratio is 1 to 1.

The bases of the transistors T1 and T2 are interconnected with the emitter of the transistor T2 connected to the negative voltage terminal −V through the second resistor R2 and the current source, while the emitter of the transistor T1 is connected through the serially arranged first and second resistors R1 and R2 and the current source. The third resistor R3 is connected to one end to the base of the second transistor T2 and to a point of reference potential, such as ground, through the first diode D1, with the other end of the third resistor R3 being connected to the collector of the second transistor T2. The collector of the PNP transistor T3 is connected to the collector of the first transistor T1, with the base of the PNP transistor T3 being connected to the collector of the second transistor T2, while the emitter of the PNP transistor is connected to the point of reference potential through the fourth resistor R4. The fourth transistor T4 has its collector connected to the point of reference potential, its base connected to the collector of the first transistor T1 and its emitter connected to the negative voltage terminal −V through the second diode D2 and the current source. An output terminal is provided at the emitter of the fourth transistor T4.

In this band gap regulator, variations in voltage with respect to temperature are compensated by choosing circuit values such that a voltage change across the emitter-base junction of the second transistor T2 is equal but opposite to the voltage change across the second resistor R2. In the regulator of this invention, the first and second transistor T1 and T2 are operated at the same current levels, but the base-emitter junction area of the first transistor T1 is greater than the corresponding area of the second transistor T2 by four to ten times. Consequently, the first transistor T1 has a lower current density than that of the second transistor T2, and, therefore, the voltage drop across the base-emitter junction of the first transistor T1 is less than that of the second transistor T2 for a given level of collector current. The temperature coefficients of the emitter-base junctions are inversely proportional to their current densities. Accordingly, the voltage produced across the first resistor R1 is equal to the difference between the base-emitter junction voltage drops of the first and second transistors T1 and T2 and has a positive temperature coefficient. Since the current flowing through the resistor R1 is proportional to this voltage difference, the voltage drop across the second resistor R2 is also proportional to this voltage difference. It can be seen that by properly choosing the circuit parameters, the voltage drop across the second resistor R2, having a positive temperature coefficient, and the voltage drop across the second transistor T2, having a negative temperature coefficient, may be combined such that their temperature coefficients cancel each other, resulting in a voltage at the output terminal having a zero temperature coefficient and a magnitude substantially equal to the band gap voltage of the semiconductor material of the transistors.

It can be seen that with the base of the fourth transistor T4 connected to the collector of the first transistor T1 and the cathode of the second diode D2 connected to the emitters of the first and second transistors T1 and T2 through the first and second resistor R1 and R2, a negative feedback path is provided, which tends to maintain the current constant at the collectors of the first and second transistors T1 and T2 with a positive temperature coefficient as previously discussed, and thus also in the current mirror circuit D1, T3, R3 and R4.

If the base current of the fourth transistor T4 increases, the emitter current of the fourth transistor T4 also increases. Since the current source produces a constant current, any increase in the emitter current of the fourth transistor causes a corresponding decrease in the current through the second resistor R2, reducing the current available to the first and second transistors T1 and T2, which decreases the current in the collectors of the first and second transistors T1 and T2. Although there is a reduction in the current flow in both transistors T1 and T2, there is a larger reduction in current flow through the second transistor T2. Due to the first resistor R1, there will be a larger change in current in the second transistor T2 than in the first transistor T1, which is reflected through the base of the third transistor T3 and into the base of the fourth transistor T4. Hence, the net feedback is negative and the regulator circuit is stabilized.

The regulated voltage is developed between the base of the transistors T1 and T2 and the common point between the second resistor R2 and the diode D2, as indicated hereinabove, however, by providing the first and second diodes D1 and D2 in the current mirror circuit and in the feedback circuit, respectively, the regulated voltage also is produced between the output terminal and ground due to the tracking between diodes D1 and D2. The first and second diodes D1 and D2 may be replaced by other elements, however, it is necessary that these elements have the same temperature coefficient of voltage. It should be further understood that the first diode D1 need not be arranged within the current mirror circuit as long as it is coupled to the base of the second transistor T2.

It should be noted that the circuit of this invention produces a small regulated negative voltage with respect to ground, which can be readily used in integrated circuits requiring a negative reference voltage.

With the current source designed to be independent of the output voltage, the regulator is self starting on power up due to the current path to ground through the second resistor R2, transistor T2 and diode D1.

The current mirror circuit D1, T3, R3 and R4 may force a current into the transconductance amplifier T1 and T2 having a 1 to 1 ratio, as indicated hereinabove, however, if desired, other ratios of current may be fed into the collectors of the first and second transistors T1 and T2 with a commensurate change in the size of the base-emitter junctions of the first and second transistors T1 and T2 to maintain the equal but opposite voltage drops across the base-emitter junction of the second transistor T2 and the second resistor R2.

Accordingly, it can be seen that a simple band gap regulator circuit has been provided in accordance with the teachings of this invention producing a relatively small, highly regulated voltage which is negative with respect to a more positive terminal such as ground. This circuit may be readily used with a negative power supply having a reduced voltage, e.g., −5 volts or less, to provide a small negative reference voltage.

While the invention has been particularly shown and described with reference to a preferred embodiment thereof, it will be understood by those skilled in the art that various changes in form and details may be made therein without departing from the spirit and scope of the invention.

What is claimed is:

1. A band gap regulator comprising a transconductance amplifier including first and second transistors, each having an emitter, a resistive network, a load circuit and a current source, and, a negative feedback circuit coupled to the emitters of said transistors through said resistive network, said load circuit and said feedback circuit each having an impedance with a similar temperature coefficient of voltage and said current source being connected to said feedback circuit and to said resistive network.

2. A band gap regulator comprising first and second transistors interconnected at their bases and each further having an emitter and a collector, a resistive network, a current mirror circuit connected between the collectors of said first and second transistors and a point of reference potential, a negative feedback circuit connected between the collector of said first transistor and the emitters of said first and second transistors through said resistive network, said negative feedback circuit having a first impedance, a second impedance having a temperature coefficient of voltage similar to that of said first impedance coupled to said second transistor, and means for applying a negative potential with respect to the point of reference potential to said negative feedback circuit and to the emitters of said first and second transistors through said resistive network.

3. A band gap regulator comprising first and second transistors interconnected at their bases, a resistive network including first and second serially arranged resistors, the emitter of said second transistor being connected to the common point between said first and second resistors, a current mirror circuit connected between the collectors of said first and second transistors and a point of reference potential, a negative feedback circuit having a first impedance connected between the collector of said first transistor and the emitters of said first and second transistors through said resistive network, a second impedance having a temperature coefficient of voltage similar to that of said first impedance coupled to the collector of said second transistor, and means for applying a negative potential with respect to the point of reference potential to said negative feedback circuit and to the emitters of said first and second transistors through said resistive network.

4. A band gap regulator as set forth in claim 3 wherein said resistive network includes first and second serially arranged resistors, the emitter of said second transistor is connected to the common point between said first and second resistors, said feedback circuit includes a first impedance and said current mirror circuit includes a second impedance having a temperature coefficient of voltage similar to that of said first impedance.

5. A band gap regulator as set forth in claim 4 wherein said first and second transistors are NPN transistors and said first and second impedances include first and second diodes, respectively.

6. A band gap regulator as set forth in claim 5 wherein said feedback circuit further includes a current source coupled to the emitter of said first transistor through said first and second resistors.

7. A band gap regulator as set forth in claim 6 wherein said feedback circuit includes a third transistor connected between the point of reference potential and said first diode with its beam connected to the collector of said first transistor.

8. A band gap regulator as set forth in claim 7 further including an output terminal connected between said first diode and said third transistor.

9. A band gap regulator as set forth in claim 8 wherein said third transistor has its collector connected to the point of reference potential and its emitter connected to said first diode.

10. A band gap regulator as set forth in claim 9 wherein said first diode interconnects said current source to said third transistor.

11. A band gap regulator as set forth in claim 10 wherein said current mirror circuit includes said second diode and a third resistor serially arranged between the point of reference potential and the collector of said second transistor, a fourth resistor and a fourth transistor serially arranged between the point of reference potential and the collector of said first transistor, said fourth transistor having its base connected to the collector of said second transistor.

12. A band gap regulator as set forth in claim 11 wherein said fourth transistor is a PNP transistor having its emitter connected to said fourth resistor and its collector connected to the collector of said first transistor.

13. A voltage reference circuit comprising a transconductance amplifier including first and second transistors interconnected at their bases and each having an emitter, a resistive network having first and second serially arranged resistors and a load circuit having a first impedance and being coupled to said transistors, and a negative feedback circuit having a second impedance coupled to the emitter of said first transistor through said first and second resistors and to the emitter of said second transistor through said first resistor, said first and second impedances having a similar temperature coefficient of voltage.

14. A voltage reference circuit as set forth in claim 13 wherein said first transistor has a base-emitter area substantially larger than that of said second transistor.

15. A voltage reference circuit as set forth in claim 14 wherein said negative feedback circuit includes a current source connected to the emitter of said second transistor through one of said first and second resistors.

16. A voltage reference circuit comprising first and second transistors having interconnected bases, first and second serially arranged resistors, a negative feedback circuit connected between the emitter and collector of said first transistor through said resistors, said feedback circuit including a series circuit having a third transistor, a first impedance and a current source disposed between a point of reference potential and a terminal having a voltage more negative than the point of reference potential, a common point between said first impedance and said current source being connected to the emitter of said second transistor through one of said resistors and the base of said third transistor being connected to the collector of said first transistor, and a current mirror circuit including a second impedance, said current mirror circuit being connected to the collectors of said first and second transistors.

17. A voltage reference circuit as set forth in claim 16 wherein said second impedance is connected to the base of said second transistor and said first and second impedances have a similar temperature coefficient of voltage.

18. A voltage reference circuit as set forth in claim 17 wherein said first, second and third transistors are of the NPN type and said first and second impedances are first and second diodes, respectively, and the cathode of said second diode is connected to the base of said second transistor, and said first transistor has a base-emitter area substantially larger than that of said second transistor.

19. A voltage reference circuit as set forth in claim 18 wherein said current mirror circuit further includes a third resistor connected at one end to the collector of said second transistor and coupled at the other end to said point of reference potential through said second diode, a fourth resistor and a fourth transistor of the PNP type having a base connected to the collector of said second transistor, a collector connected to the collector of said first transistor and an emitter coupled to the point of reference potential through said fourth resistor.

* * * * *